United States Patent [19]

Broghammer et al.

[11] 4,357,692

[45] Nov. 2, 1982

[54] BELL-STRIKING CLOCK

[75] Inventors: Rudolf Broghammer, Eschbronn-Mariazell; Franz Käser, St. Georgen, both of Fed. Rep. of Germany

[73] Assignee: Fabrik fur Technische Laufwerke und Apparate Kundo Kieninger & Obergfell, St. Georgen, Fed. Rep. of Germany

[21] Appl. No.: 197,501

[22] Filed: Oct. 16, 1980

Related U.S. Application Data

[63] Continuation-in-part of Ser. No. 128,518, Mar. 10, 1980, Pat. No. 4,276,625, which is a continuation-in-part of Ser. No. 29,758, Apr. 12, 1979, abandoned.

[30] Foreign Application Priority Data

Oct. 17, 1979 [DE] Fed. Rep. of Germany ..... 2941942

[51] Int. Cl.[3] ..... G04C 21/06

[52] U.S. Cl. ..... 368/75; 368/243; 368/250; 340/384 E; 340/392

[58] Field of Search ..... 368/75, 71, 243, 251, 368/250, 248; 340/384 E, 384 R, 392

[56] References Cited

U.S. PATENT DOCUMENTS 3,210,924 10/1965 Dodd ..... 340/248

3,689,919 9/1972 Ganter et al. ..... 340/392

4,073,133 2/1978 Earls et al. ..... 340/384 E

*Primary Examiner*—B. A. Reynolds

*Assistant Examiner*—Philip H. Leung

*Attorney, Agent, or Firm*—Karl F. Ross

[57] ABSTRACT

An electronic clock emitting half-hourly time signals corresponding to ships' bells comprises an electromagnetic striker driven by a crystal-controlled oscillator via a multistage binary frequency divider whose last several stages, with the exception of the penultimate stage, have outputs interconnected by a logical coincidence gate to generate a succession of output pulses occurring in pairs during the first half of every cycle of a square wave emitted by the final stage. This square wave steps a motor which drives an associated clockwork entraining a multibank rotary switch and alternately closing, for short periods on the full hour and on the half hour, respective contacts which transmit the square wave to a control circuit including an electronic pulse counter. The control circuit, on being triggered by the second half of a wave cycle, emits an enabling signal which unblocks another gate in cascade with the coincidence gate to pass one or more output pulses to the striker for operating same, with simultaneous stepping of the pulse counter which terminates the enabling signal when its count matches a signal code generated by the rotary switch.

8 Claims, 4 Drawing Figures

BELL-STRIKING CLOCK

CROSS-REFERENCE TO RELATED APPLICATION

This is a continuation-in-part of our copending application Ser. No. 128,518, now U.S. Pat. No. 4,276,625, filed Mar. 10, 1980 as a continuation-in-part of application Ser. No. 29,758 filed Apr. 12, 1979 and now abandoned.

FIELD OF THE INVENTION

Our present invention relates to an electronic clock emitting time signals which correspond to the strokes of ships' bells.

BACKGROUND OF THE INVENTION

As is known, ships' bells are sounded on both the half and the full hour with a pattern of strokes recurring after a 4-hour operating period or "watch". The number of strokes is odd on the half hour and even (i.e. one, two, three or four stroke pairs) on the full hour. The separation of the stroke pairs on the 2nd, 3rd and 4th hour is greater than the interval between the strokes of any pair; on the preceding half hour, similarly, the stroke pair or pairs are followed after a larger interval by a single stroke.

In earlier times, clocks of this type were widely used aboard naval vessles and merchant ships for the purpose of giving chronometric information by acoustic signaling to the seamen on duty. The half-hour timing stems from the original use of 30-minute sandglasses for this purpose. With the 24-hour day divided into six 4-hour watches, the number of bells generally conforms to the following program:

| | | | |
|---|---|---|---|
| Midnight | (noon) | 8 bells | (beginning of watch) |
| 0030 hours | (1230 hours) | 1 bell | |
| 0100 hours | (1300 hours) | 2 bells | |
| 0200 hours | (1400 hours) | 4 bells | |
| 0230 hours | (1430 hours) | 5 bells | |
| 0300 hours | (1500 hours) | 6 bells | |
| 0330 hours | (1530 hours) | 7 bells | |
| 0400 hours | (1600 hours) | 8 bells | (change of watch) |
| 0430 hours | (1630 hours) | 1 bell | (beginning of new watch) |
| and so forth. | | | |

Although so-called ships' clocks are no longer in common use aboard naval and commercial vessels, they are popular as timepieces on pleasure boats and even in dwellings.

A variety of electronic circuits have already been proposed for the operation of a striker mechanism in response to periodic switch closures by an associated clockwork. See, for example, U.S. Pat. Nos. 3,689,919 and 3,210,924, the latter referring particularly to a ship's clock. Our copending application and patent identified above disclose a simple, inexpensive and reliable electronic control system for a clock of this character, operating with low current consumption so as to be usable for prolonged periods even with battery-operated clocks.

OBJECT OF THE INVENTION

The object of our present invention is to provide a further improvement in the circuitry of such an electronic clock and to simplify its realization in integrated form.

SUMMARY OF THE INVENTION

Our improved electronic clock comprises, similarly to that of our copending application and patent, a pulse generator producing a square wave with interleaved first and second half-cycles of different voltage levels, each half-cycle preferably having a duration of one second. As in our earlier system, this pulse generator is connected to a control circuit via circuitry including normally open switch means briefly closed by an associated clockwork every thirty minutes to trigger that control circuit into emitting an enabling signal to unblock a normally blocked circuit in order to feed one or more output pulses (up to eight), occurring in pairs during first half-cycles of the square wave, to a striker mechanism responding thereto by sounding a stroke for each pulse; the triggering is effected during a second half-cycle of the square wave to insure full development of all output pulses transmitted to the striker. The number of output pulses reaching the striker, and therefore the number of strokes sounded, is again determined by timing means coupled with the clockwork and connected to the control circuit for establishing progressively longer durations for the enabling signal, spanning from one to eight output pulses, during times of closure of the switch means at the ends of successive half-hour intervals of a four-hour operating period or watch.

Whereas, however, the striker-actuating pulses were generated in our earlier system by a normally blocked astable multivibrator upon an unblocking thereof by the enabling signal from the circuit, our present improvement utilizes instead a normally blocked gate inserted between the striker input and a coincidence circuit having inputs connected to respective outputs of the aforementioned pulse generator and of a second pulse generator synchronized therewith to produce a pulse train with a cadence or repetition frequency equaling four times that of the square wave produced by the first pulse generator. Thus, the coincidence circuit emits a pair of output pulses during each first half-cycle of the square wave but never during a second half-cycle thereof, these output pulses reaching the striker mechanism only when the gate downstream of the coincidence circuit is unblocked by the enabling signal from the control circuit.

Advantageously, pursuant to a more particular feature of our present invention, the first and second pulse generators are a final stage and an antepenultimate stage of a frequency divider with a multiplicity of cascaded binary stages driven by a source of higher-frequency oscillations. This source could be a free-running astable multivibrator of adjustable operating frequency, yet we prefer to use therefor a crystal-controlled fixed-frequency oscillator which can also serve to drive the clockwork, e.g. via a stepping motor operated by the square wave fed to the control circuit as in our prior system.

BRIEF DESCRIPTION OF THE DRAWING

The above and other feature of our invention will now be described in detail with reference to the accompanying drawing in which.

SPECIFIC DESCRIPTION

Figure 1:
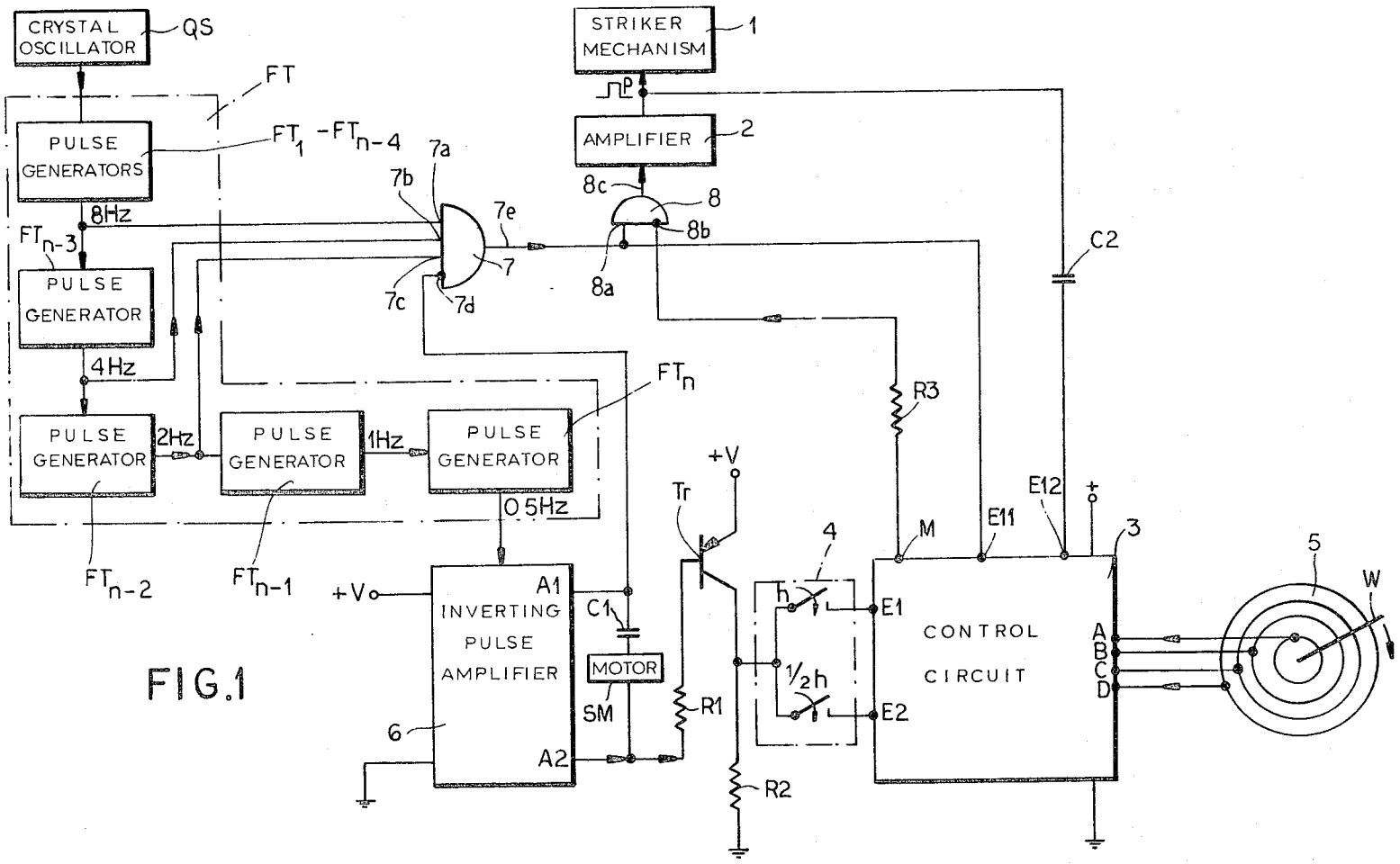
FIG. 1 is a block diagram of a sound-generating system for a ship's clock according to the present improvement.

FIG. 1 shows a striker mechanism 1, advantageously an electromagnetic one of the type described in our copending application Ser. No. 128,518 whose disclosure is hereby incorporated by reference into the present application, responsive to short voltage pulses P emitted from time to time by an output 8*c* of an AND gate 8 via a power amplifier 2. These pulses are obtained from a coincidence circuit, shown as an AND gate 7 with three noninverting inputs 7*a*–7*c* and an inverting input 7*d*, whose output 7*e* is tied to a noninverting input 8*a* of gate 8. The several inputs of gate 7 are connected to respective state outputs of a frequency divider FT driven by a high-frequency crystal-controlled oscillator QS. Divider FT comprises n cascaded binary stages the last four of which, respectively designated $FT_{n-3}$, $FT_{n-2}$, $FT_{n-1}$ and $FT_n$, have been shown as separate pulse generators while the preceding ones, designated $FT_1$–$FT_{n-4}$, have been shown combined into a single block. The final stage $FT_n$ emits a square wave with a frequency of 0.5 Hz, corresponding to frequencies of 1 Hz for the penultimate stage $FT_{n-1}$, 2 Hz for the antepenultimate stage $FT_{n-2}$, 4 Hz for the immediately preceding stage $FT_{n-3}$ and 8 Hz for the stage $FT_{n-4}$ before that one. The outputs of the three last-mentioned stages are respectively connected to inputs 7*c*, 7*b* and 7*a* of gate 7 whose inverting input 7*d* is connected to the output of stage $FT_n$ via an inverting pulse amplifier 6; the latter has power inputs respectively tied to a positive pole +V and a grounded negative pole of a voltage source, such as a battery, also energizing other components of the system. An inverting second input 8*b* of gate 8 is connected through a resistor $R_3$ to an output terminal M of a control circuit 3 more fully described hereinafter with reference to FIG. 2.

Figure 4:
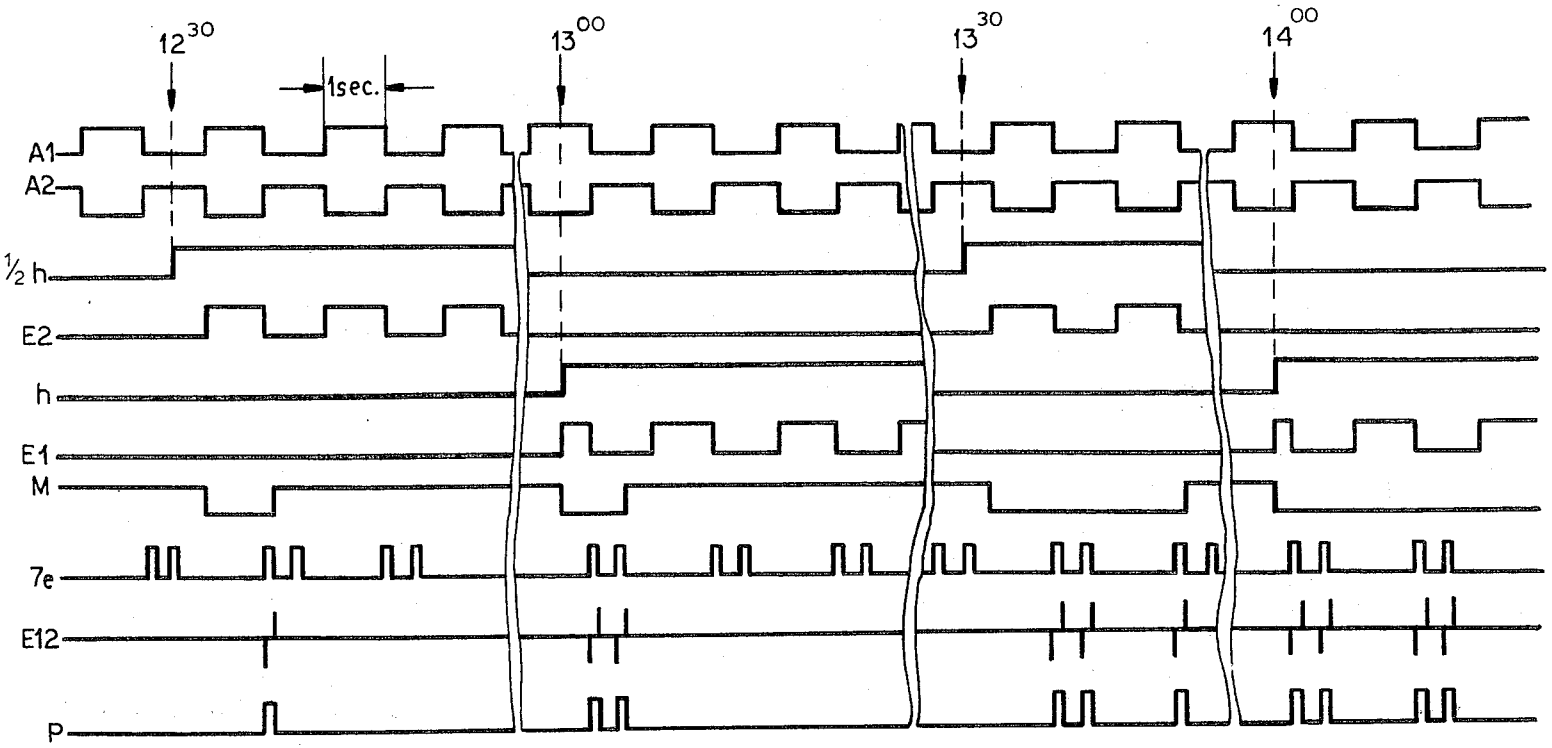
FIG. 4 is a set of graphs relating to the operation of the overall system of FIG. 1.

A stepping motor SM, serving to drive the nonillustrated hands of an associated clockwork, is inserted in series with a capacitor C1 between output terminals A1 and A2 of pulse amplifier 6 carrying mutually complementary square waves as shown in the corresponding graphs of FIG. 4. The negative half-cycles of these square waves are at zero level and, like the intervening positive half-cycles, have a duration of one second corresponding to a 2-second wave cycle, i.e. to the output frequency (0.5 Hz) of divider stage $FT_n$. With n=23, oscillator QS will operated at a frequency above 4 MHz. Gate input 7*d*, shown connected to terminal A1, could be made noninverting and be connected instead to terminal A2.

A PNP transistor Tr, with an emitter connected to positive supply +V and a collector grounded via a resistor R2, has its base connected to output terminal A2 by way of a series resistor R1. A mechanical interrupter 4, controlled by the clockwork, comprises a pair of full-hour contacts h and half-hour contacts ½h which are normally open and are inserted between the collector lead of transistor Tr and respective inputs E1, E2 of control circuit 3. This control circuit has also four inputs tied to leads A, B, C, D that are energized in certain combinations, as more fully described hereinafter, by a timer in the form of a multibank rotary switch 5 comprising a wiper W connected to potential which is driven by the clockwork to sweep four sets of bank contacts during a 4-hour operating period or watch. During that operating period, contacts h and ½h close for several seconds on the full hour and on the half hour, respectively, as shown in the corresponding graphs of FIG. 4. Transistor Tr, acting as an amplifier, decoupler and phase corrector, inverts the square wave appearing on output terminal A2 so that these contacts receive positive voltage concurrently with the appearance of positive potential on output terminal A1 of pulse amplifier 6.

Figure 3:
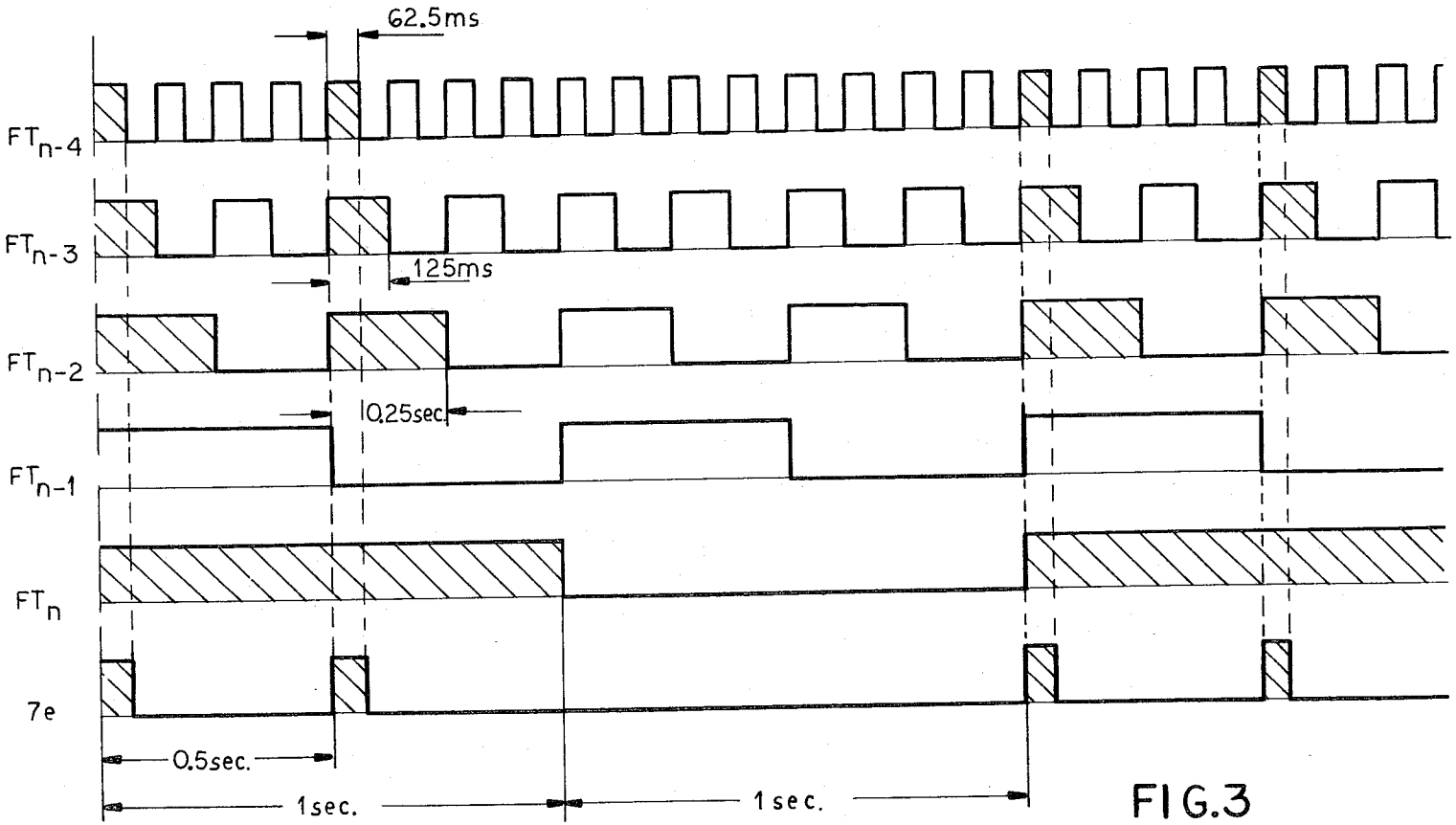
FIG. 3 is a set of graphs relating to the operation of pulse-generating means shown in FIG. 1.

During those half-cycles of the square wave when the voltage level of terminal A1 is zero, AND gate 7 conducts twice as indicated in the graph designated 7*e* in FIG. 3. Each output pulse thus emitted by gate 7 lasts for 62.5 ms, equal to the pulse width on the output of divider stage $FT_{n-4}$. If the connection to gate input 7*a* were omitted, the pulse width would be doubled to 125 ms; with stage $FT_{n-3}$ also disconnected from gate 7, the pulses would have their maximum permissible width of 0.25 second or one eighth of a cycle of the square wave appearing on the outputs of components $FT_n$ and 6. On the other hand, the pulses on output 7*e* could be further narrowed by extending output connections from one or more earlier divider stages to gate 7. Whenever control circuit 3 grounds the input 8*b* of gate 8, as described hereinafter, corresponding pulses P appear on the output of amplifier 2 and give rise to a brief current surge through striker mechanism 1, resulting in the sounding of one stroke.

In FIG. 3 the pulses effective to unblock the gate 7 for energizing its output 7*e* have been distinctively hatched.

Control circuit 3 has a further input terminal E11, tied directly to output 7*e* of gate 7 and thus also to input 8*a* of gate 8, and an additional input terminal E12, connected to the output of amplifier 2 via a differentiating capacitor C2.

Figure 2:
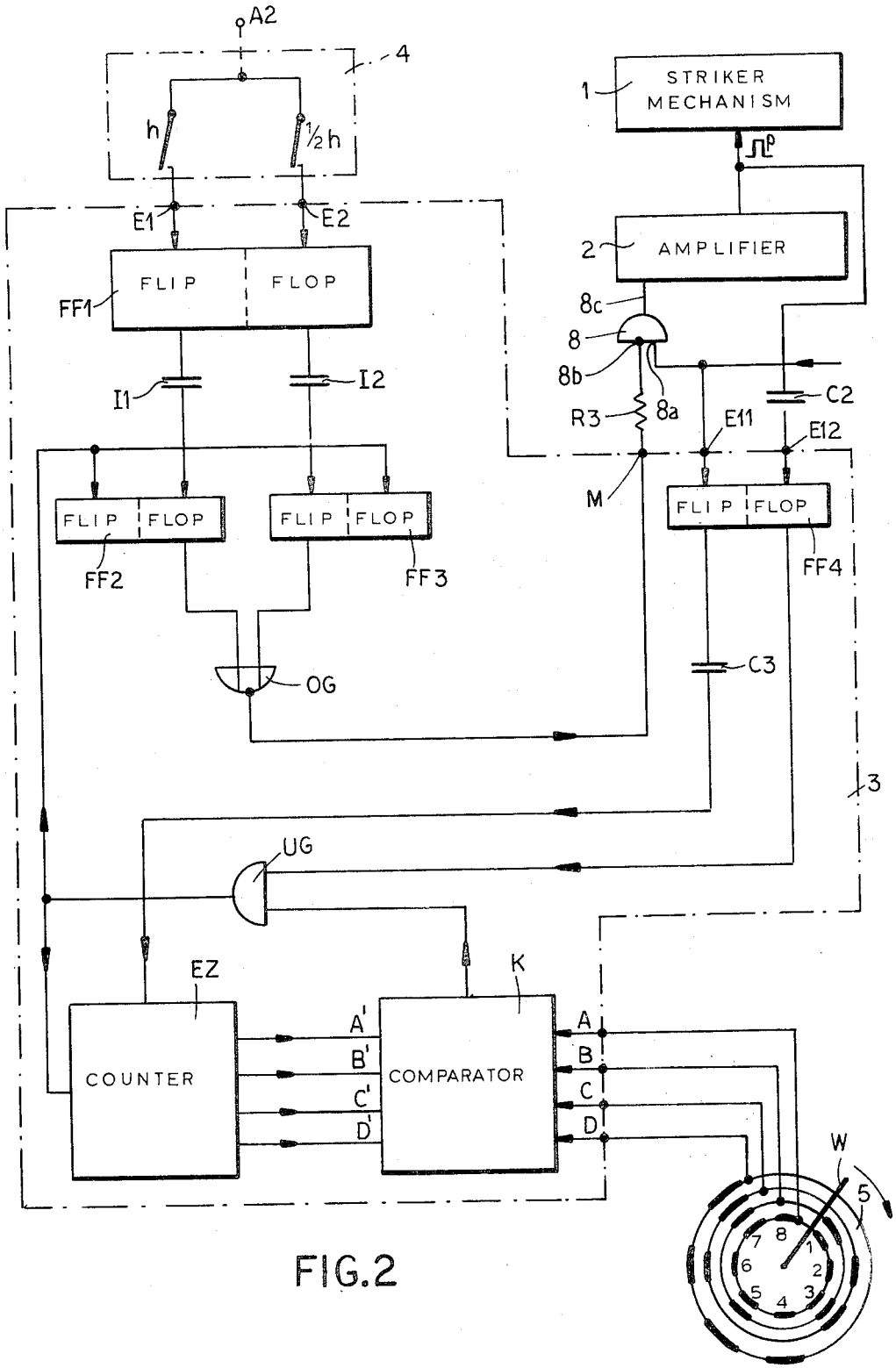
FIG. 2 shows details of a control circuit included in the diagram of FIG. 1.

As shown in FIG. 2, control circuit 3 comprises several flip-flops FF1, FF2, FF3 and FF4 as well as a binary pulse counter EZ and a comparator K, the latter being connected on the one hand to the output leads A–D of timer 5 and on the other hand to corresponding stage outputs A′–D′ of counter EZ; lead A′ need not emanate from the counter but could be permanently connected to potential. Flip-flop FF1 has setting and resetting inputs respectively tied to terminals E1 and E2, a set output connected via a capacitor 11 (acting as a differentiator or pulse sharpener) to a setting input of flip-flop FF2, and a reset output connected via a similar capacitor I2 to a setting input of flip-flop FF3. The set outputs of flip-flops FF2 and FF3 are connected via a NOR gate OG to terminal M emitting the aforedescribed unblocking signal to gate input 8*b* when either of these flip-flops is set. (Component OG could also be an OR gate, in which case input 8*b* will be noninverting.) Flip-flop FF4 has setting and resetting inputs respectively tied to terminals E11 and E12, a set output connected via a differentiating capacitor C3 to a stepping input of counter EZ, and a reset output connected to an input of an AND gate UG whose other input is tied to an output of comparator K (obviously, the first input of gate UG could be made inverting and be connected instead to the set output of the flip-flop). The output of AND gate UG is connected to resetting inputs of flip-flops FF2, FF3 and of counter EZ.

The innermost contact bank of timer 5, connected to lead A, comprises eight contacts engaged by wiper W for a limited time in positions 45° apart. The other three banks have contacts which energize the leads B, C and D in respective wiper positions according to the binary representations of numbers 0 (position 8) and 1–7. Identical signal patterns appear on the stage outputs B′, C′ and D′ of counter EZ when the latter has taken a corresponding number of steps on negative-going voltage changes in the set output of flip-flop FF4, i.e. whenever the latter is being reset; during the 30-minute intervals between closures of contacts of interrupter 4, flip-flop FF4 is continuously set by the recurrent pulse pairs appearing on gate output 7*e* tied to terminal E11.

FIG. 4 shows a first closure of the mechanically operated switch contacts ½h occurring at 1230 hours, thus at the end of the first half hours of the watch beginning at noon. That closure, as shown, happens to coincide with zero voltage on terminal A1 and is therefore not immediately effective since the collector lead of transistor Tr (FIG. 1) is grounded at this time by the inverted square wave of terminal A2. At the beginning of the next half-cycle, positive voltage on that collector lead results in a switchover of flip-flop FF1 which sets the flip-flop FF2, thereby cutting off the NOR gate OG so that terminal M goes to zero as likewise shown in FIG. 4. Another half-cycle later, when the potential terminal A1 goes to zero, gate 8 unblocked by the grounding of terminal M emits a single pulse P which passes the amplifier 2 and is differentiated by capacitor C2 to produce an ineffectual negative spike on terminal E12. As soon as the generated pulse P terminates, a positive spike appearing at terminal E12 resets the flip-flop FF4; the disappearance of positive voltage on the set output of this flip-flop is converted by capacitor C3 into a stepping pulse for counter EZ (the counter could also be stepped directly by the resetting pulse on terminal E12). With wiper W in its No. 1 position, leads A and B are energized as are leads A′ and B′ since counter EZ has taken a single step. AND gate UG, therefore, conducts and resets the counter EZ as well as the flip-flops FF2 and FF3. This ends the enabling signal (zero voltage) at terminal M so that no further pulses can be passed by gate 8. With the counter thus reset, comparator K no longer detects a match between the codes on its two sets of inputs and de-energizes its output together with that of gate UG.

Thirty minutes later, i.e. at 1300 hours, contacts h close at an instant which happens to coincide with a positive half-cycle of the wave on terminal A1. Thus, flip-flop FF1 is immediately switched, setting flip-flop FF2 and generating the enabling signal at terminal M. At the beginning of the next half-cycle, the coincidence of zero voltage on terminals A1 and M unblocks the gate 8 which thereupon passes two consecutive pulses P during that half-cycle. Since counter EZ has been stepped twice by as many settings and resettings of flip-flop FF4, comparator K now detects agreement between the signal patterns on its two sets of input leads and, via coincidence gate UG, restores the control circuit to normal.

At 1330 hours, contacts ½h are again closed during a negative (i.e. zero-voltage) half-cycle of the square wave on terminal A1. At the end of that half-cycle, as described above, flip-flop FF1 is switched over, setting flip-flop FF3 and removing positive potential from terminal M, thus resulting in the passage of two consecutive pulses P by gate 8 in the immediately following half-cycle. Since comparator K does not detect an identity of signal patterns at this point, gate 8 remains open so that one further pulse is passed at the beginning of the next-following negative half-cycle. At that instant, comparator K cuts off further pulse transmission through gate 8 and amplifier 2 as soon as the positive spike on terminal E12, resetting the flip-flop FF4, confirms that the last pulse P has been fully developed.

The use of two parallel interrupter contacts and three flip-flops FF1–FF3 ensures that gate 8 will be unblocked only if contacts h and ½h are alternatively closed. If this precaution is not required, a single pair of interrupter contacts closing every 30 minutes to set one flip-flop resettable by the output of gate UG will be sufficient; NOR gate OG may then be replaced by an inverter in the set output of that flip-flop, or may be omitted if terminal M is connected to the reset output thereof or if gate input 8*b* is made noninverting.

The control circuit 3 and other components of the system of FIG. 1 can be easily realized with the aid of commercially available integrated-circuit modules.

We claim:

1. An electronic clock emitting time signals corresponding to the strokes of ships' bells, comprising:

a clockwork provided with driving means;

normally open switch means briefly closed by said clockwork every thirty minutes;

first pulse-generating means for producing a square wave with interleaved first and second half-cycles of different voltage levels;

second pulse-generating means synchronized with said first pulse-generating means for producing a pulse train with a cadence equaling four times that of said square wave;

a coincidence circuit with inputs connected to respective outputs of said first and second pulse-generating means for producing pairs of output pulses only during said first half cycles of said square wave;

a striker mechanism connected via a normally blocked gate to said coincidence circuit for sounding a stroke in response to each output pulse passed by said gate in an unblocked state thereof;

a control circuit connected to said first pulse-generating means via circuitry including said switch means for receiving several cycles of said square wave during each time of closure of said switch means, said control circuit being triggerable by said second half-cycle into emitting an enabling signal unblocking said gate; and timing means coupled with said clockwork and connected to said control circuit for establishing progressively longer durations for said enabling signal, spanning from one output pulse to eight output pulses, during times of closure of said switch means at the ends of successive half-hour intervals of a four-hour operating period.

2. An electronic clock as defined in claim 1 wherein said first pulse-generting means is a final stage of a frequency divider comprising a multiplicity of cascaded binary stages driven by a source of higher-frequency oscillations, said second pulse-generating means being an antepenultimate stage of said frequency divider.

3. An electronic clock as defined in claim 2 wherein said source is a crystal-controlled oscillator, said driving means comprising a stepping motor connected to a stage output of said frequency divider.

4. An electronic clock as defined in claim 2 wherein said coincidence circuit is provided with additional input means connected to at least one stage of said frequency divider immediately preceding said antepenultimate stage for narrowing said output pulses to not more than one eighth of a half-cycle of said square wave.

5. An electronic clock as defined in claim 1, 2, 3 or 4 wherein said control circuit includes a pulse counter, connected to be stepped by each output pulse passed by said gate, and a comparator with first input means connected to said pulse counter and with second input means connected to said timing means for detecting a match between the setting of said pulse counter and a numerical code emitted by said timing means and for thereupon resetting said pulse counter and terminating said enabling pulse.

6. An electronic clock as defined in claim 5 wherein said timing means comprises a rotary switch with four sets of bank contacts engaged in different combinations by a wiper in eight angular positions thereof.

7. An electronic clock as defined in claim 5 wherein said switch means comprises a first contact pair closed by said clockwork on the full hour and a second contact pair in parallel with said first contact pair closed by said clockwork on the half hour, said control circuit including a first flip-flop with setting and resetting inputs respectively connected to said first and second contact pairs, a second flip-flop with a setting input connected to a set output of said flip-flop, a third flip-flop with a setting input connected to a reset output of said first flip-flop, a fourth flip-flop settable by an output pulse of said coincidence circuit and resettable by the trailing edge of an output pulse passed by said gate, said pulse counter being stepped by said trailing edge concurrently with a resetting of said fourth flip-flop, and a coincidence gate with inputs connected to said comparator and to an output of said fourth flip-flop, said second and third flip-flops and said pulse counter having resetting inputs connected to an output of said coincidence gate.

8. An electronic clock as defined in claim 1, 2, 3 or 4 wherein each half-cycle of said square wave has a duration of one second.

* * * * *